US005400046A

United States Patent [19]

Ilcisin et al.

[11] Patent Number: 5,400,046

[45] Date of Patent: Mar. 21, 1995

[54] ELECTRODE SHUNT IN PLASMA CHANNEL

[75] Inventors: Kevin J. Ilcisin; John S. Moore, both of Beaverton, Oreg.

[73] Assignee: Tektronix, Inc., Wilsonville, Oreg.

[21] Appl. No.: 26,674

[22] Filed: Mar. 4, 1993

[51] Int. Cl.[6] ..... G09G 3/22

[52] U.S. Cl. ..... 345/58; 315/169.4; 345/60; 345/98

[58] Field of Search ..... 345/60, 62, 65, 66, 345/67, 68, 58, 98; 315/169.4, 169.1

[56] References Cited

U.S. PATENT DOCUMENTS

| | | | |
|---|---|---|---|
| 3,262,010 | 7/1966 | Kazan | 315/63 |
| 3,812,486 | 5/1974 | Purchase | 340/324 M |
| 3,955,187 | 5/1976 | Bigelow | 340/324 M |
| 4,066,929 | 1/1978 | Okamoto et al. | 345/65 |
| 4,117,472 | 9/1978 | Freer et al. | 340/324 M |
| 4,319,239 | 3/1982 | Stephens | 340/784 |
| 4,322,659 | 3/1982 | De Jule et al. | 315/169.1 |
| 4,352,101 | 9/1982 | De Jule | 340/769 |
| 4,391,492 | 7/1983 | Lu et al. | 350/351 |
| 4,450,441 | 5/1984 | Person et al. | 340/773 |
| 4,485,380 | 11/1984 | Soneda et al. | 340/784 |
| 4,554,537 | 11/1985 | Dick | 340/775 |
| 4,652,087 | 3/1987 | Bos et al. | 350/332 |
| 4,845,482 | 7/1989 | Howard et al. | 340/805 |
| 4,892,389 | 1/1990 | Kuijk | 350/333 |
| 4,896,149 | 1/1990 | Buzak et al. | 340/794 |
| 4,924,148 | 5/1990 | Schwartz | 345/60 |
| 4,924,218 | 5/1990 | Weber et al. | 345/67 |
| 4,945,352 | 7/1990 | Ejiri | 340/805 |
| 5,077,553 | 12/1991 | Buzak | 340/794 |

FOREIGN PATENT DOCUMENTS 0251230 1/1988 European Pat. Off. .

OTHER PUBLICATIONS

Howard et al., "Eliminating Crosstalk in Thin Film Transistor/Liquid Crystal Displays," *International Display Research Conference,* 230–35, 1988.

Powell et al., "A 6-in. Full Color Liquid Crystal Television Using an Active Matrix of Amorphous-Silicon TFTs," *Proceedings of the SID,* 227–232, vol. 29/3 1988.

Mikoshiba, Shigeo, "Plasma Displays," Seminar 10, SID 1987, 10.2–10.37.

Firester, Arthur H., "Active Matrices for Liquid-Crystal Displays," Seminar 5, SID 1987, 5.2–5.25.

Scheffer, Terry J., "Direct-Multiplexed Liquid-Crystal Displays," Seminar 4, SID 1987, 4.2–4.34.

Howard, W. E., "Active-Matrix Techniques for Displays," Proceedings of the SID, vol. 27/4, 313–326.

Dick, George W., "Plasma Display Panel Techniques," Seminar 2, SID 1985 2.2–1–2.2.–54.

Matsumoto et al., "4.1 Voltage Averaging Driving Method," *The Newest Technology of Liquid Crystal,* Kogyo Chosakai Co., 106, 1983.

*Primary Examiner*—Tommy P. Chin
*Assistant Examiner*—A. Au
*Attorney, Agent, or Firm*—John D. Winkelman; James W. Jandacek

[57] ABSTRACT

A method and apparatus for reducing cross-talk across the width of a pixel, cross-talk along the length of a channel, flicker, and/or image sticking in a display system by providing (a) an electrical circuit (resistor 102, switch 108) for bringing a reference electrode (30') and a row electrode (62') in a channel (20') to the same potential before the gaseous medium in the channel loses an ability to redistribute charge and (b) an electrical circuit (driver 104 and/or driver 26) operable to bring or to clamp one or both of those electrodes to a predetermined electrical potential. Corresponding methods are also provided.

25 Claims, 8 Drawing Sheets

ELECTRODE SHUNT IN PLASMA CHANNEL

TECHNICAL FIELD

The present invention pertains to electrical circuits for, and methods of, operating electrode structures in systems constructed of data storage elements which employ an ionizable gas to address an array of such storage elements.

BACKGROUND OF THE INVENTION

U.S. Pat. No. 4,896,149, issued Jan. 23, 1990, to Buzak et al. ("'149 Patent") and assigned to the assignee of the present application, discloses an addressing structure using an ionizable gaseous medium. Such an addressing structure may be used in a system constructed of data storage elements which addresses those data storage elements with the use of an ionizable gas. An example of such a system is a flat panel display, a video camera, or a memory system.

The system disclosed in the '149 patent has an electrode structure which defines rows of channels, each of which is filled with an ionizable gas. Extending along the base of each of those channels are a row electrode and a reference electrode. The row electrode is electrically driven as a cathode, and the reference electrode is referenced to ground and acts as an anode when the row electrode is electrically driven as a cathode. When a particular row electrode is driven as a cathode, the ionizable gas in the particular channel which contains that row electrode is ionized, and the system operates as disclosed in the '149 patent.

One embodiment of the system disclosed in the '149 patent is a flat panel display system in which the electric field across an electro-optic material containing a liquid crystal material is changed in response to data signals provided over data electrodes.

Several types of distortion are observed when operating such a flat panel display. Low or high intensity (e.g., generally black or generally white) streaks (in this case, gradients in intensity) often appear in a direction transverse to the length of a channel between the two sides of individual display elements ("pixels") defined in part by the channel ("cross-talk across the width of a pixel"). In addition, low, intermediate, and high intensity (e.g., generally black, grey, and generally white) streaks extending along the length of a channel (i.e., parallel to the reference electrode and the row electrode) often appear between the two sides of pixels above a channel that contains multiple pixels that are intended to have highest intensity (e.g., to appear black) ("horizontal cross-talk along the length of a channel"). In addition, pixels often flicker between low, intermediate, and high intensity ("flicker") or continue to display an image from a preceding image field ("image sticking"). All these types of distortion interfere with proper imaging of high and low intensity pixels and proper production of grey scale levels and color intensity levels in pixels.

Other types of cross-talk interference which may arise in the operation of a flat panel liquid crystal display in accordance with the '149 patent are addressed in U.S. patent applications Ser. Nos. 07/854,145, for REDUCING CROSS TALK EFFECTS IN ELECTRO-OPTICAL ADDRESSING STRUCTURES, filed Mar. 19, 1992; 07/958,631 for an ADAPTIVE DRIVE WAVEFORM FOR REDUCING CROSSTALK EFFECTS IN ELECTRO-OPTICAL ADDRESSING STRUCTURES, filed Oct. 9, 1992; and 08/026,367 for an ELECTRO-OPTICAL ADDRESSING STRUCTURE HAVING REDUCED SENSITIVITY TO CROSS-TALK, filed concurrently herewith. A type of image distortion that may occur in the operation of such a flat panel display is discussed in U.S. patent application Ser. No. 08/026,366, for a KICKER PULSE CIRCUIT FOR AN ADDRESSING STRUCTURE USING AN IONIZABLE GASEOUS MEDIUM, filed concurrently herewith. Each of those applications is assigned to the assignee of the present application. It is preferable to eliminate cross-talk and other distortion to the greatest practicable extent in the operation of a flat panel liquid crystal display in accordance with the '149 patent.

There is accordingly a need to reduce or eliminate any one or more of the specific distortions of cross-talk across the width of a pixel, horizontal cross-talk along the length of a channel, flicker, and image sticking in the operation of such flat panel displays.

SUMMARY OF THE INVENTION

An object of the present invention is, therefore, to reduce or eliminate any one or more of the specific distortions of cross-talk across the width of a pixel, horizontal cross-talk along the length of a channel, flicker, and image sticking in the operation of a plasma-addressed flat panel display of the type described in the '149 patent.

The invention satisfies the need and meets the technical objective set forth above by providing a method of operating an electrode structure of the type disclosed on the '149 patent and a new and improved electrode structure of that type.

Applying a strobe pulse or ionizing signal between the row electrode and the reference electrode in a plasma channel in an addressable electro-optic system causes an electrical discharge in the gaseous medium in the channel and thereby excites quantities of the gaseous medium to one or more excited states as defined below. The strobe pulse is of a character to impart to the gaseous medium a discharge time ability to redistribute electrical charge among surfaces exposed to the channel. The discharge time is the time during which electrical circuits external to the gaseous medium place the reference electrode and the row electrode in a channel at a different potential so as to create or maintain a discharge in the gaseous mechanism. The strobe pulse cooperates with data signals during the discharge time to change the electro-optical properties of the regions of an electro-optical layer associated with the data storage elements (pixels). Preferably the strobe pulse is also of a character to impart the discharge time ability throughout the active portion (i.e., the portion of the length below the data electrodes) of the channel.

After the discharge time has elapsed, the strobe pulse or ionizing signal is removed; the gaseous medium then contains free electrons and positively-charged ions (collectively "charge carriers"), and preferably also contains nonionized metastable atoms and/or molecules (collectively "metastables") that remain after the discharge is extinguished in the gaseous medium. The metastables are preferably atoms, more preferably noble gas atoms, and more preferably helium atoms. Metastables have a bound electron in an excited state from which the electron cannot transition to a state of lower energy by emitting electromagnetic radiation (e.g., the 19.6 electron volt metastable state of helium). As a result, metastables typically have a relatively long decay time in physical systems. Metastables are thus a reservoir of potential energy for producing charge carriers through processes such as collisions. Charge carriers and metastables are all in excited states.

Charge carriers move rapidly in response to electric fields existing within the channel so as to tend to bring the interior of the channel to a field-free condition. Typically charge carriers that exist when the strobe pulse or ionizing signal is removed are redistributed to surfaces exposed to the channel and/or neutralized (hereinafter collectively "neutralized") within a short neutralization time after the discharge time has elapsed.

The metastables preferably have a decay time in the channel that is longer than the neutralization time. Because the metastables are neutral, for practical purposes they do not move in response to electric fields existing within the channel. Thus, the metastables are for practical purposes not drawn by such fields into collisions with surfaces exposed to the gaseous medium. In contrast, charge carriers move rapidly into such collisions. Many of the metastables that remain when the strobe pulse or ionizing signal is removed produce charge carriers. Charge carriers produced as a result of such metastables also move rapidly in response to any electric field existing within the channel so as to tend to bring the interior of the channel to a field-free condition.

The result of the processes involving either or preferably both of charge carriers and metastables is thus the production of a field-free condition in the interior of the channel. This condition is produced by the deposition on surfaces exposed to the channel of surface charge distributions that, together with any electric field applied to the channel, produce the field-free condition. A sufficient quantity of the gaseous medium is in one or more excited states after the discharge time has elapsed to provide the gaseous medium with a temporary ability to redistribute charge to make the interior of the channel free of electric fields. Preferably the sufficient quantity imparts the temporary ability throughout the active portion of the channel. The interval (which includes the neutralization time) after the discharge time has elapsed and until the gaseous medium loses the temporary ability to redistribute charge is the plasma decay time.

The methods and systems in accordance with the invention bring the row electrode and the reference electrode in each channel to the same electrical potential after the discharge time has elapsed but before the gaseous medium has lost the temporary ability to redistribute charge. The strobe pulse or ionizing signal is of a character that provides in one or more excited states an excited quantity of the gaseous medium sufficient after the discharge time has elapsed to provide the gaseous medium with the temporary ability to redistribute electrical charge to make the interior of the channel free of electric fields. The gaseous medium is preferably provided with atoms and/or molecules from which metastables of the type described above are produced during the discharge. This allows ready production of charge carriers as a result of the metastables under conditions existing in the channel after the discharge time has elapsed. Preferably helium is provided in the gaseous medium; its characteristics promote those goals. Its 19.6 electron volt nonionized metastable state allows such ready production of charge carriers. The temporary ability to redistribute charge can in principle result from charge carriers alone during the neutralization time (e.g., where the gas is hydrogen), from metastables alone during the plasma decay time, or (preferably) from both of those sources.

The invention includes a wide variety of alternative methods of operating the addressing structure. A first group of methods reduces one or more of the specific distortions discussed above by bringing the row electrode and the reference electrode in each channel to the same electrical potential after the discharge time has elapsed but before the ionizable gaseous medium has lost the temporary ability to redistribute charge. A second group of methods reduces one or more of the specific distortions discussed above by bringing the potential of one of the row electrode and the reference electrode in each channel to a predetermined potential before the gaseous medium has lost the temporary ability to redistribute charge.

The invention also includes a wide variety of alternative electrode structures that operate in accordance with the methods of the invention.

Additional objects and advantages of the present invention will be apparent from the detailed description of preferred embodiments thereof, which proceeds with reference to the accompanying drawings.

DETAILED DESCRIPTION OF PREFERRED EMBODIMENTS

The following discussion with reference to FIGS. 1–6 is based on the '149 patent to provide background for the description of the present invention. The figure numbers used in the following discussion are the same as those of the present disclosure.

Figure 1:
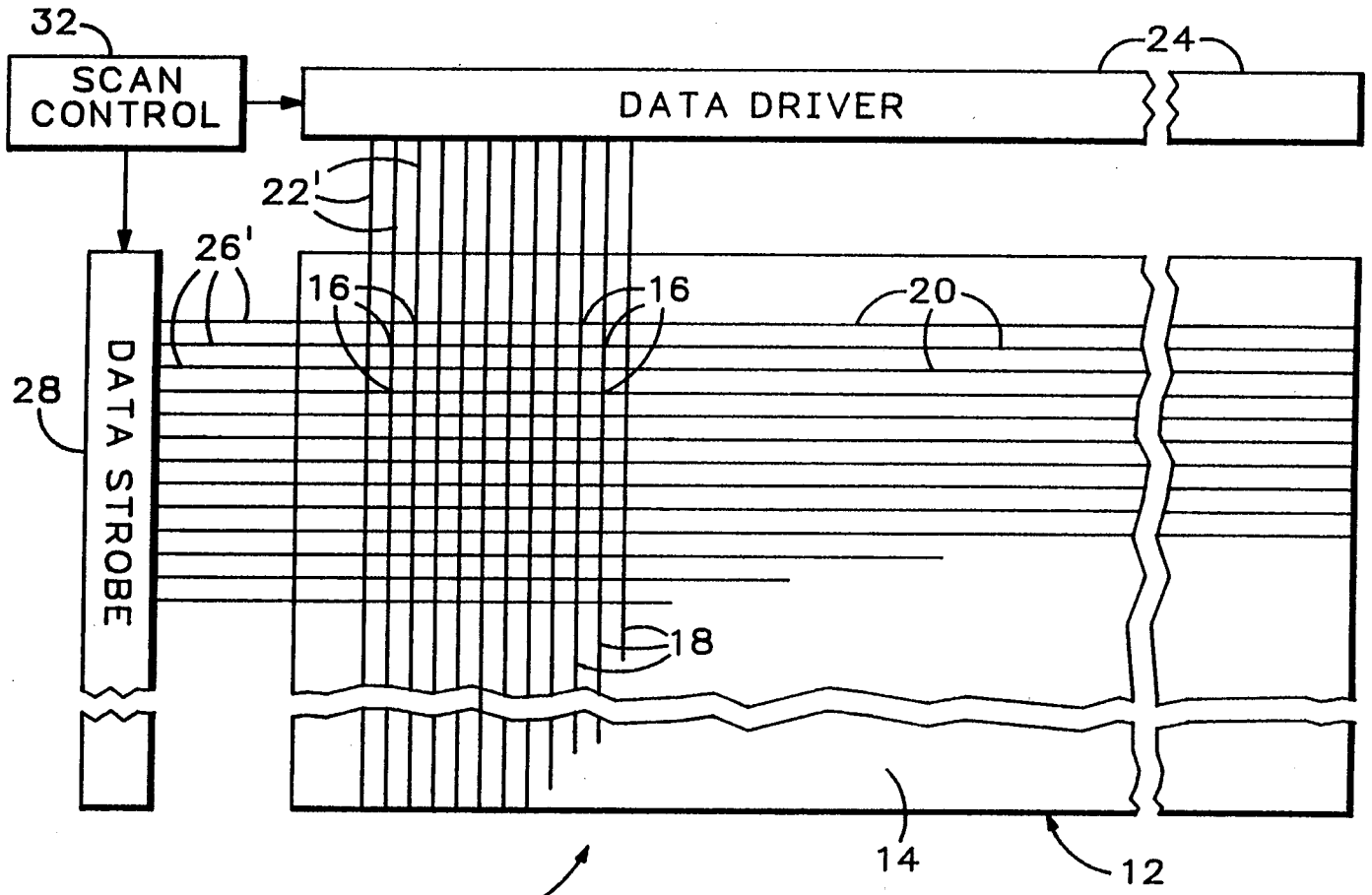
FIG.1 PRIOR ART
FIG. 1 is a diagram showing a frontal view of the display surface of a display panel and associated drive circuitry of a display system described in the '149 patent.

FIG. 1 shows a flat panel display system 10, which represents a first embodiment that implements the addressing structure and carries out the addressing method of the '149 patent. With reference to FIG. 1, flat panel display system 10 comprises a display panel 12 having a display surface 14 that contains a pattern formed by a rectangular planar array of nominally identical data storage or display elements 16 mutually spaced apart by predetermined distances in the vertical and horizontal directions. Each display element 16 in the array represents the overlapping portions of thin, narrow electrodes 18 arranged in vertical columns and elongate, narrow channels 20 arranged in horizontal rows. (The electrodes 18 are hereinafter referred to as "column electrodes 18.") The display elements 16 in each of the rows of channels 20 represent one line of data.

The widths of column electrodes 18 and channels 20 determine the dimensions of display elements 16, which are of rectangular shape. Column electrodes 18 are deposited on a major surface of a first electrically nonconductive, optically transparent substrate, and channels 20 are inscribed in a major surface of a second electrically nonconductive, optically transparent substrate, as will be further described below. Skilled persons will appreciate that certain systems, such as a reflective display of either the direct view or projection type, would require that only one of the substrates be optically transparent.

Column electrodes 18 receive data drive signals of the analog voltage type developed on parallel output conductors 22' by different ones of the output amplifiers 22 (FIGS. 2–6) of a data driver or drive circuit 24, and channels 20 receive data strobe signals of the voltage pulse type developed on parallel output conductors 26' by different ones of the output amplifiers 26 (FIGS. 2–6) of a data strobe or strobe means or strobe circuit 28. Each of the channels 20 includes a reference electrode 30 (FIG. 2) to which a reference potential common to each channel 20 and data strobe 28 is applied.

To synthesize an image on the entire area of display surface 14, display system 10 employs a scan control circuit 32 that coordinates the functions of data driver 24 and data strobe 28 so that all columns of display elements 16 of display panel 12 are addressed row by row in row scan fashion. Display panel 12 may employ electro-optic materials of different types. For example, if it uses such a material that changes the polarization state of incident light rays 33, display panel 12 is positioned between a pair of light polarizing filters 34 and 36 (FIG. 2), which cooperate with display panel 12 to change the luminance of light propagating through them. The use of a scattering liquid crystal cell as the electro-optic material would not require the use of polarizing filters 34 and 36, however. A color filter (not shown) may be positioned within display panel 12 to develop multi-colored images of controllable color intensity. For a projection display, color can also be achieved by using three separate monochrome panels 10, each of which controls one primary color.

With reference to FIGS. 2–5, display panel 12 comprises an addressing structure that includes a pair of generally parallel electrode structures 40 and 42 spaced apart by a layer 44 of electro-optic material, such as a nematic liquid crystal, and a thin layer 46 of a dielectric material, such as glass, mica, or plastic. Electrode structure 40 comprises a glass dielectric substrate 48 that has deposited on its inner surface 50 column electrodes 18 of indium-tin oxide, which is optically transparent, to form a striped pattern. Adjacent pairs of column electrodes 18 are spaced apart a distance 52, which defines the horizontal space between next adjacent display elements 16 in a row.

Figure 2:
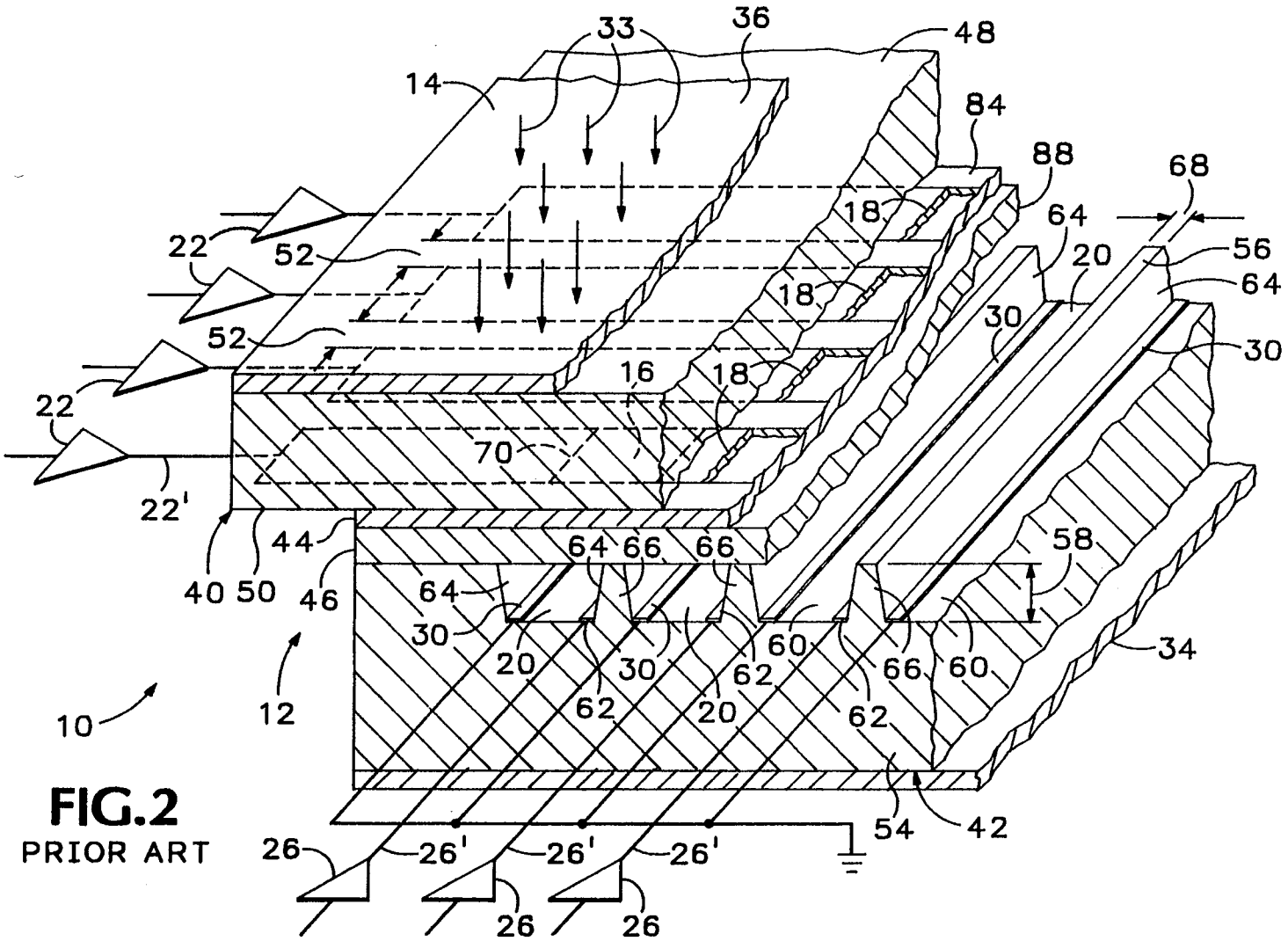
FIG.2 PRIOR ART
FIG. 2 is an enlarged fragmentary isometric view showing the layers of structural components forming the display panels described in the '149 patent as viewed form the left side in FIG. 1.
Figure 3:
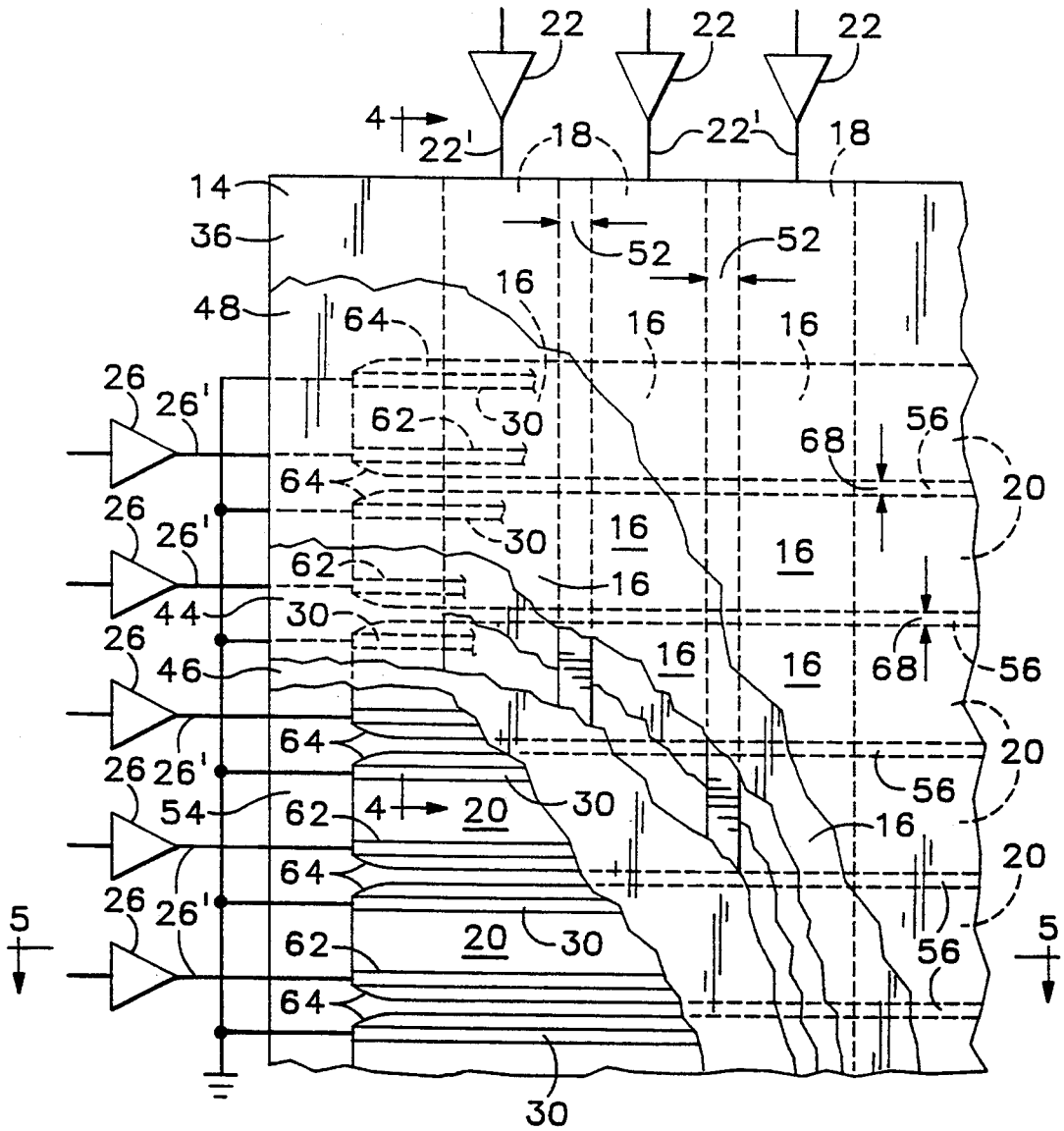
FIG.3 PRIOR ART
FIG. 3 is an enlarged fragmentary frontal view with portions broken away to show different depthwise views of the interior of the display panel of FIG. 2.
Figure 5:
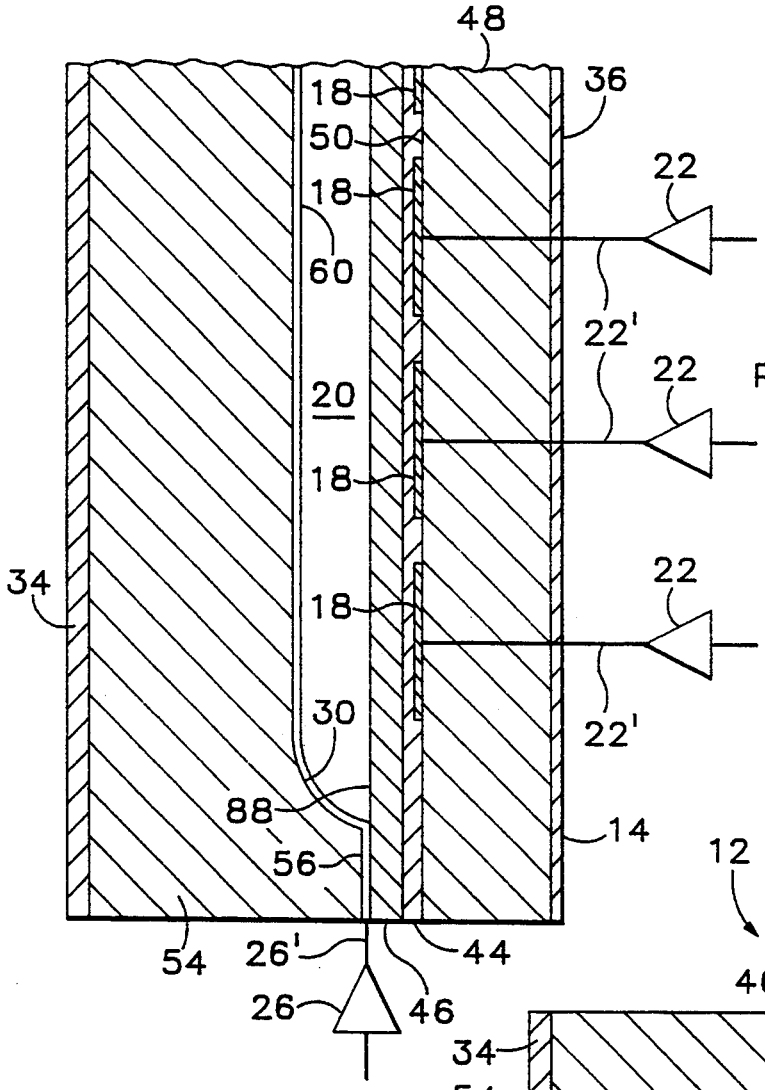
FIG.5 PRIOR ART
FIG. 5 is an enlarged sectional view taken along lines 5—5 of FIG. 3.
Figure 4:
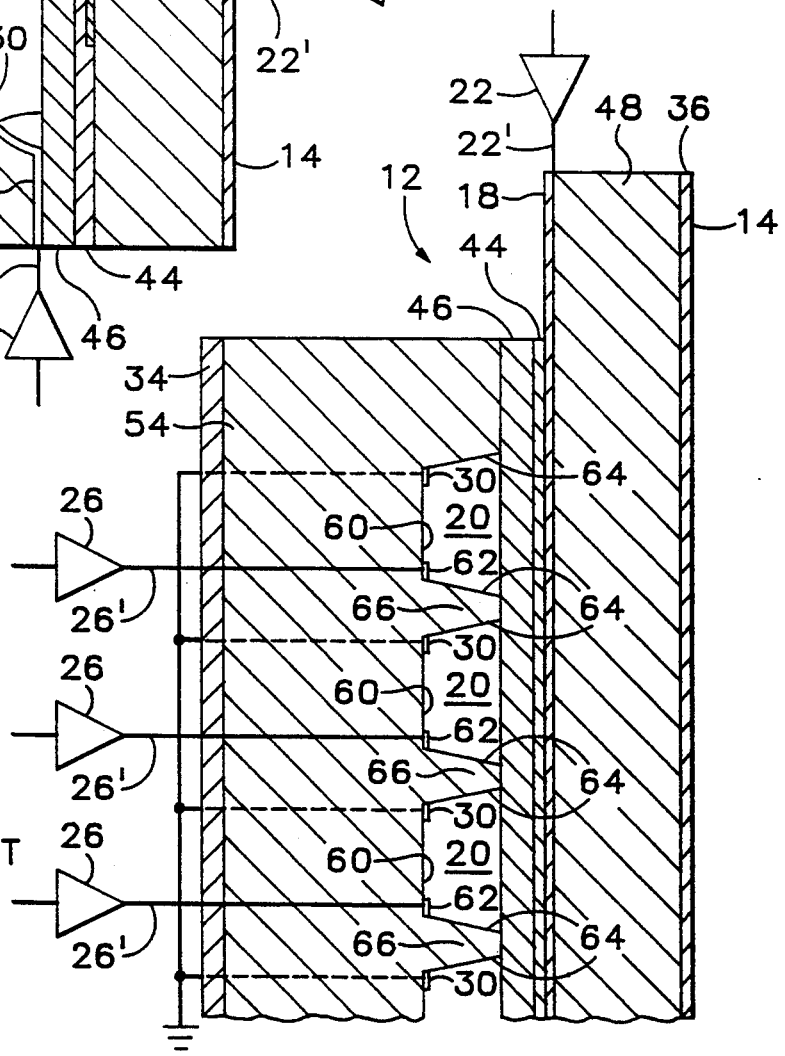
FIG.4 PRIOR ART
FIG. 4 is an enlarged sectional view taken along lines 4—14 of FIG. 3.

Electrode structure 42 comprises a glass dielectric substrate 54 into whose inner surface 56 multiple channels 20 of trapezoidal cross section are inscribed. Channels 20 have a depth 58 measured from inner surface 56 to a base portion 60. Each one of the channels 20 has a pair of thin, narrow nickel electrodes 30 and 62 extending along base portion 60 and a pair of inner side walls 64 diverging in the direction away from base portion 60 toward inner surface 56. The reference electrodes 30 of the channels 20 are connected to a common electrical reference potential, which can be fixed at ground potential as shown. The electrodes 62 of the channels 20 are connected to different ones of the output amplifiers 26 (of which three and five are shown in FIG. 2 and FIG. 3, respectively) of data strobe 28. (The electrodes 62 are hereinafter referred to as "row electrodes 62.") To ensure proper operation of the addressing structure, the reference electrodes 30 and row electrodes 62 preferably are connected to the electrical reference potentials and the outputs 26' of data strobe 28, respectively, on opposite sides of display panel 10.

The sidewalls 64 between adjacent channels 20 define a plurality of support structures 66 whose top surfaces 56 support layer 46 of dielectric material. Adjacent ones of channels 20 are spaced apart by the width 68 of the top portion of each support structure 66, which width 68 defines the vertical space between next adjacent display elements 16 in a column. The overlapping regions 70 of column electrodes 18 and channels 20 define the dimensions of display elements 16, which are shown in dashed lines in FIGS. 2 and 3. FIG. 3 shows with better clarity the array of display elements 16 and the vertical and horizontal spacings between them.

The magnitude of the voltage applied to column electrodes 18 specifies the distance 52 to promote isolation of adjacent column electrodes 18. Distance 52 is typically much less than the width of column electrodes 18. The inclinations of the side walls 64 between adjacent channels 20 specify the distance 68, which is typically much less than the width of channels 20. The widths of the column electrodes 18 and the channels 20 are a function of the desired image resolution, which is specified by the display application. It is desirable to make distances 52 and 68 as small as possible. In current models of display panel 12, the channel depth 58 is one-third the channel width.

Each of the channels 20 is filled with an ionizable gas, preferably one that includes helium, for reasons that will be explained below. Layer 46 of dielectric material functions as an isolating barrier between the ionizable gas contained within channel 20 and layer 44 of liquid crystal material. The absence of dielectric layer 46 would permit either the liquid crystal material to flow into the channel 20 or the ionizable gas to contaminate the liquid crystal material, however. Dielectric layer 46 may be eliminated from displays that employ a solid or encapsulated electro-optic material.

Figure 6:
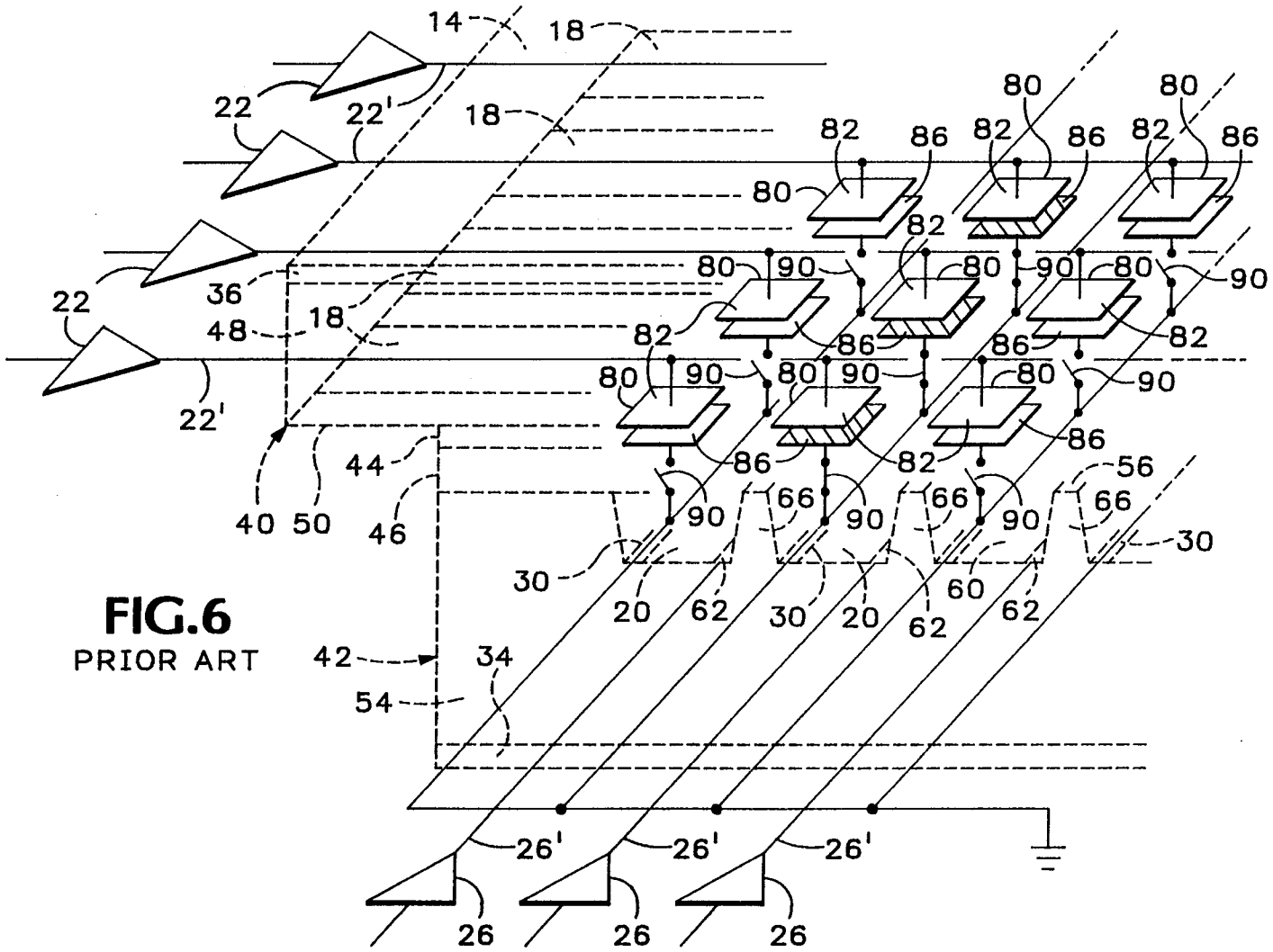
FIG.6 PRIOR ART
FIG. 6 is an equivalent circuit showing for a display system the operation of the plasma as a switch for an exemplary row receiving a data strobe pulse and three exemplary data columns receiving a data drive signal.

The principles underlying the operation of display panel 12 are that (1) each of its display elements 16 functions as a sampling capacitor for analog voltage data applied to the column electrode 18 forming a part of the display element and (2) the ionizable gas functions as a sampling switch. FIG. 6 is an equivalent circuit to which the following explanation of the operation of display system 10 refers.

With reference to FIG. 6, each of display elements 16 of display panel 12 can be modeled as a capacitor 80 (hereinafter "capacitor model 80"), whose top plate 82 represents one of the column electrodes 18 (FIG. 2) and whose bottom plate 86 represents the free surface 88 (FIG. 2) of layer 46 of the dielectric material. Capacitor model 80 represents the capacitive liquid crystal cell formed by an overlapping region of a column electrode 18 and a channel 20. The description herein of the operation of display system 10 refers to the capacitor model 80.

In accordance with the basic addressing procedure, data driver 24 captures a first line of data, which represents discrete samples of the time-varying voltage of analog data signal in a time interval of predetermined duration. The sample of the magnitude of the data signal at a particular instance within the time interval represents the magnitude of the analog voltage applied to a capacitor model 80 in a corresponding column position of the row electrode 62 receiving a strobe pulse. Data driver 24 develops on its output conductors 22 the analog voltages that are applied to column electrodes 18. In FIG. 6, four exemplary output amplifiers 22 of data driver 24 deliver analog voltages of positive polarity with respect to reference electrode 30 to the respective ones of column electrodes 18 to which they are connected. The application of a positive voltage on a column electrode 18 induces on free surface 88 (FIG. 2) of layer 46 of the dielectric material a voltage that is essentially equal to the magnitude of the applied voltage. This causes no change in the potential difference across capacitor model 80 and is represented in FIG. 6 by a top plate 82 and a bottom plate 86 with white (non-shaded) surfaces.

In this instance, the gas contained in a channel 20 is in a nonionized state, and the analog voltage developed on plates 82 and 86 of capacitor model 80 is positive with respect to the voltage potential of reference electrode 30 in the channel. Whenever data strobe 28 develops a negative-going voltage pulse of sufficient magnitude on the row electrode 62 positioned within a channel 20, the gas in the channel assumes an ionized state (i.e., becomes a plasma). The channel 20 whose row electrode receives the strobe pulse is represented in FIG. 6 in dark, thick lines. Under these conditions, the grounded reference electrode 30 and the strobed row electrode 62 function as an anode and a cathode, respectively, for the plasma contained within the channel.

The electrons in the plasma neutralize the induced positive voltage on the bottom plates 86 of capacitor models 80. The capacitor models 80 in the strobed row are charged with the data voltages applied across them. This condition is indicated in FIG. 6 by top plates 82 with white surfaces and bottom plates 86 with lined surfaces. Upon completion of the storage of the data voltages across capacitor models 80, data strobe 28 terminates the negative-going voltage pulse on the row electrode 62 of the strobed channel 20, thereby ending the strobe pulse and extinguishing the plasma.

Each of the row electrodes 62 is strobed in a similar manner until the entire display surface 14 is completely addressed and thereby stores an image field of data. The voltage remains stored across each of the capacitor models 80 in the strobed row for a time at least as long as the duration of the image field and is nearly independent of subsequent changes in data voltage applied to top plate 82 capacitor model 80. The voltage stored across each of the capacitor models 80 changes in accordance with the analog data voltages representing the display data of the next succeeding image field.

In a display system 10 whose image fields are in a noninterlaced format, the analog data voltages applied to column electrodes 18 in the next succeeding image field are of opposite polarity. Alternating between positive and negative polarities from one image field to the next image field provides a long term zero net DC voltage, which is typically required for long term operation of liquid crystal materials. The liquid crystal material produces the gray scale effect in response to the root-mean-square (rms) value of the applied analog voltage data. The display image produced is, therefore, unaffected by alternate changes in polarity of the analog voltage data.

In a display system 10 whose image fields are in an interlaced format, the analog data voltages applied to column electrodes 18 in next succeeding image frames are of opposite polarity to achieve the long term zero net DC voltage. Each image frame includes two image fields of which each comprises one-half the number of addressable lines.

The description presented above indicates that the ionizable gas contained within each of the channels 20 operates as an electrical switch 90 whose contact position changes between binary switching states as a function of the voltage applied by data strobe 28. The switches 90 shown in FIG. 6 in the open position are connected to reference electrodes 30 and are driven by a strobe pulse applied to row electrodes 62. The absence of a strobe pulse allows the gas within the channels 20 to be in a nonionized state and thereby be in a nonconducting state. The switches 90 shown in FIG. 6 in the closed position are connected to a reference electrode 30 and are driven by a strobe pulse that is applied to row electrode 64 and is of a magnitude that causes the gas within the channel 20 to be in an ionized state and thereby be in a conducting state. In FIG. 6, the amplifier 26 shown in the middle of the three output amplifiers 26 of data strobe 28 strobes a row of capacitor models 80 to establish and store the display data voltages across them.

To function as a switch, the ionizable gas contained within channels 20 beneath electrode structure 40 communicates with layer 46 of the dielectric material to provide an electrically conductive path from layer 46 of the dielectric material to reference electrode 30. The plasma in a channel 20 whose row electrode 62 receives a strobe pulse provides a ground path to the capacitor model 80 representing the portion of liquid crystal material positioned adjacent the plasma. This allows the capacitor models 80 to sample the analog data voltages applied to column electrodes 18. Extinguishing the plasma acts to remove the conducting path, thereby allowing the data sample to be held across the display element. The voltages remain stored across layer 44 of the liquid crystal material until voltages representing a new line of data in a subsequent image field are developed across the layer 44. The above-described addressing structure and technique provide signals of essentially 100% duty cycle to every one of the display elements 16.

Figure 7:
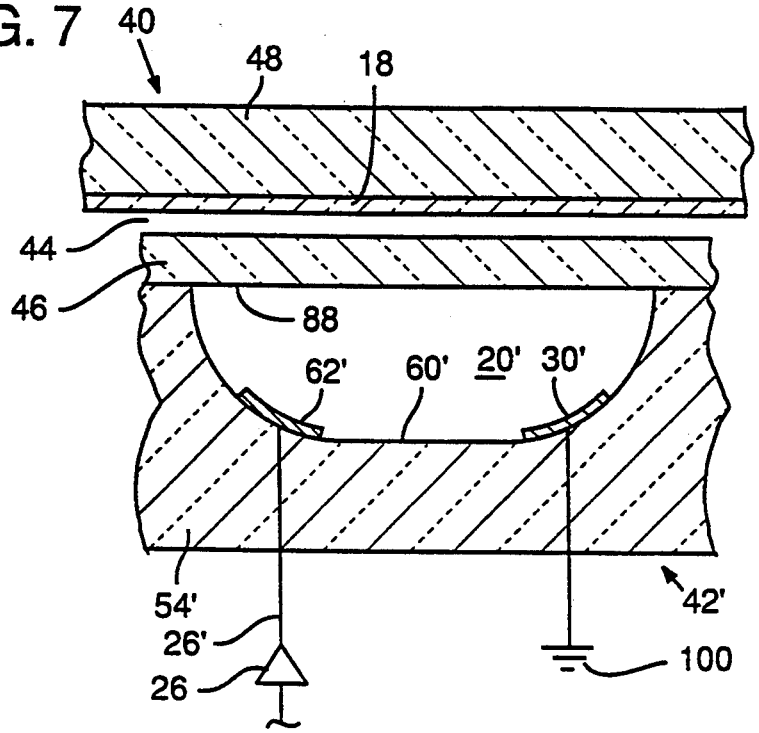
FIG. 7 shows the electrical configuration of a reference electrode and a row electrode as discussed in connection with FIGS. 1–6.
Figure 9:
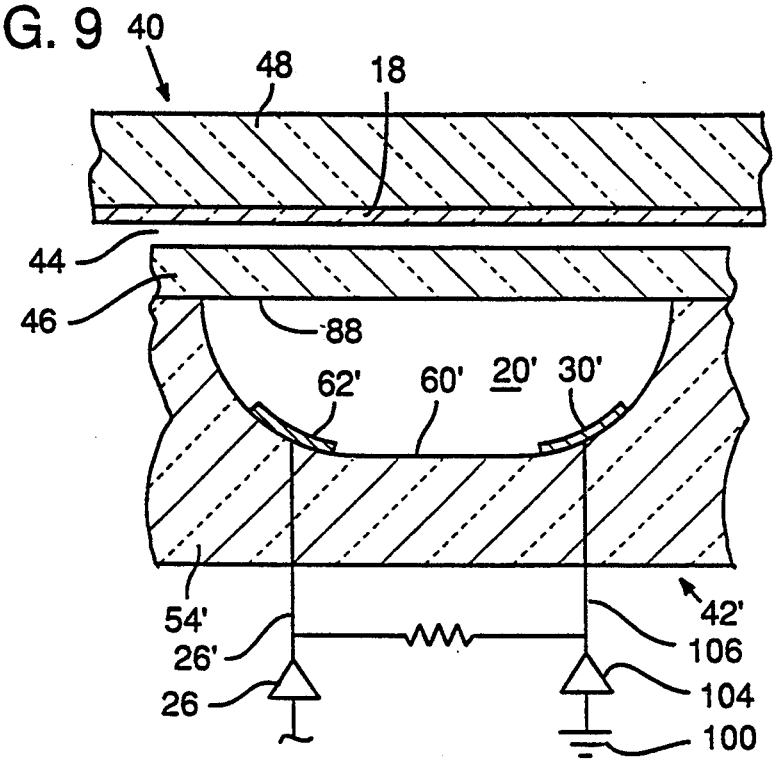
FIG. 9 shows the electrical configuration of an improved electrode structure in accordance with a first preferred embodiment of the present invention.
Figure 11:
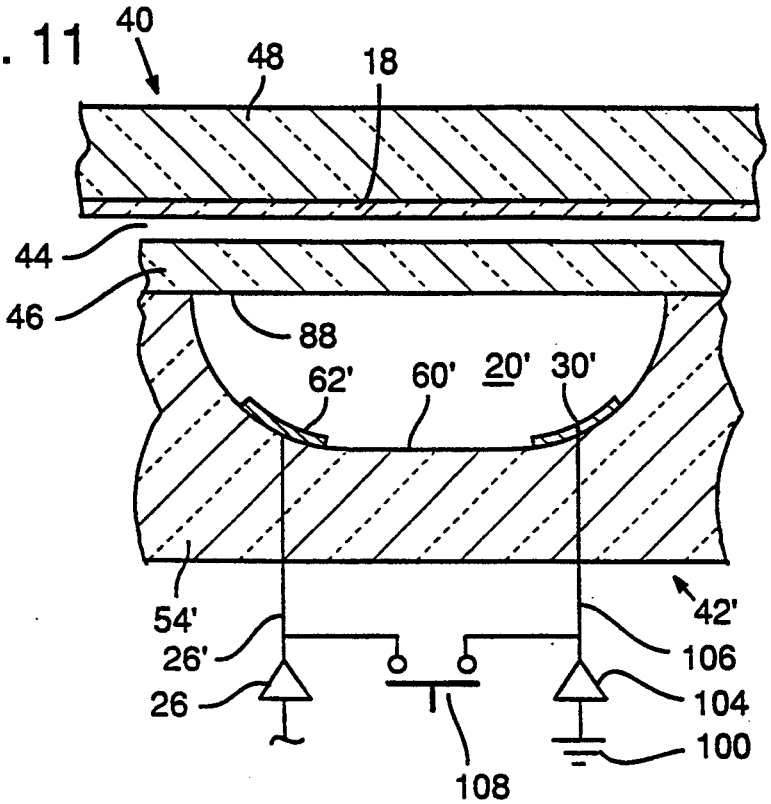
FIG. 11 shows the electrical configuration of an improved electrode structure in accordance with a second preferred embodiment of the present invention.

FIGS. 7, 9, and 11 are fragmentary, cross-sectional (across the width and perpendicular to the length of a channel and through one row electrode 18), partly schematic views of a selected channel 20' in a flat panel display system of the type described in connection with FIGS. 1–6. Channel 20' has an approximately flattened-hemispherical cross-section that is the practical outcome of attempting to produce with conventional photopatterning and etching techniques the more preferred trapezoidal cross-section of channel 20 shown in FIGS. 1–6.

As shown in FIGS. 7, 9, and 11, channel 20' is formed in a lower electrode structure 42' and a dielectric 54' and contains a reference electrode 30' and a row electrode 62'. The preceding discussion with respect to channel 20, reference electrode 30, lower electrode structure 42, dielectric 54, base portion 60, and row electrode 62 applies to corresponding components with identical reference numerals followed by primes. When electro-optic material 44 is a liquid crystal, dielectric layer 46 is preferably separated from inner surface 50 of electrode structure 40 as described in U.S. patent application Ser. No. 08/026,394 for SPACERS FOR USE IN AN ELECTRO-OPTICAL ADDRESSING STRUCTURE, filed concurrently herewith and assigned to the assignee of the present application.

Figure 8:
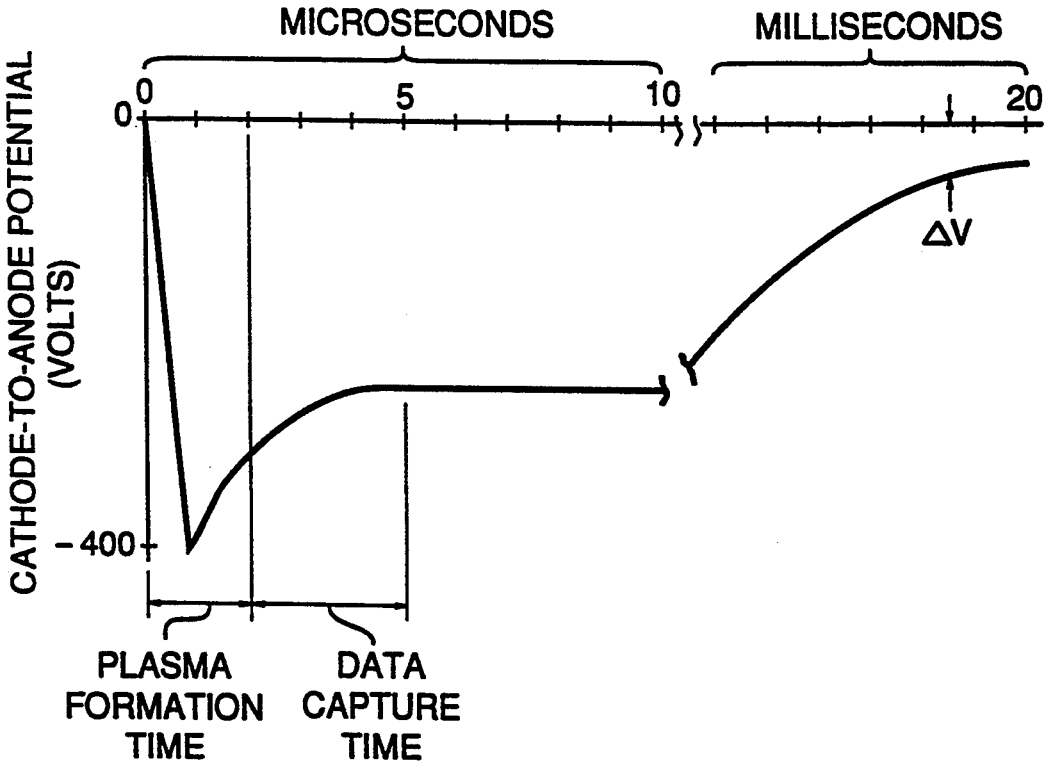
FIG. 8 is a qualitatively illustrative graph of the electrical potential expected to exist between the reference electrode (anode) and the row electrode (cathode) as a function of time after provision of an ionization signal between them for the electrical configuration shown in FIG. 7.
Figure 10:
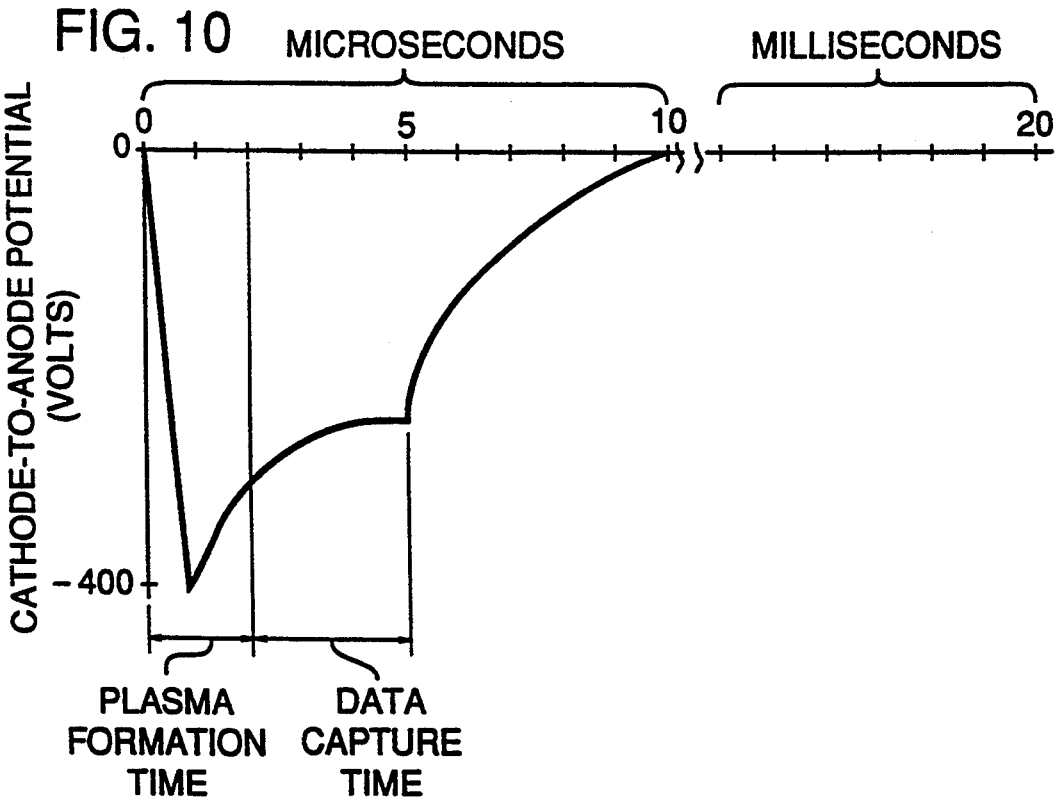
FIG. 10 is a qualitatively illustrative graph of the electrical potential expected to exist between the reference electrode (anode) and the row electrode (cathode) as a function of time after provision of an ionization signal between them for the electrical configuration shown in FIG. 9.
Figure 12:
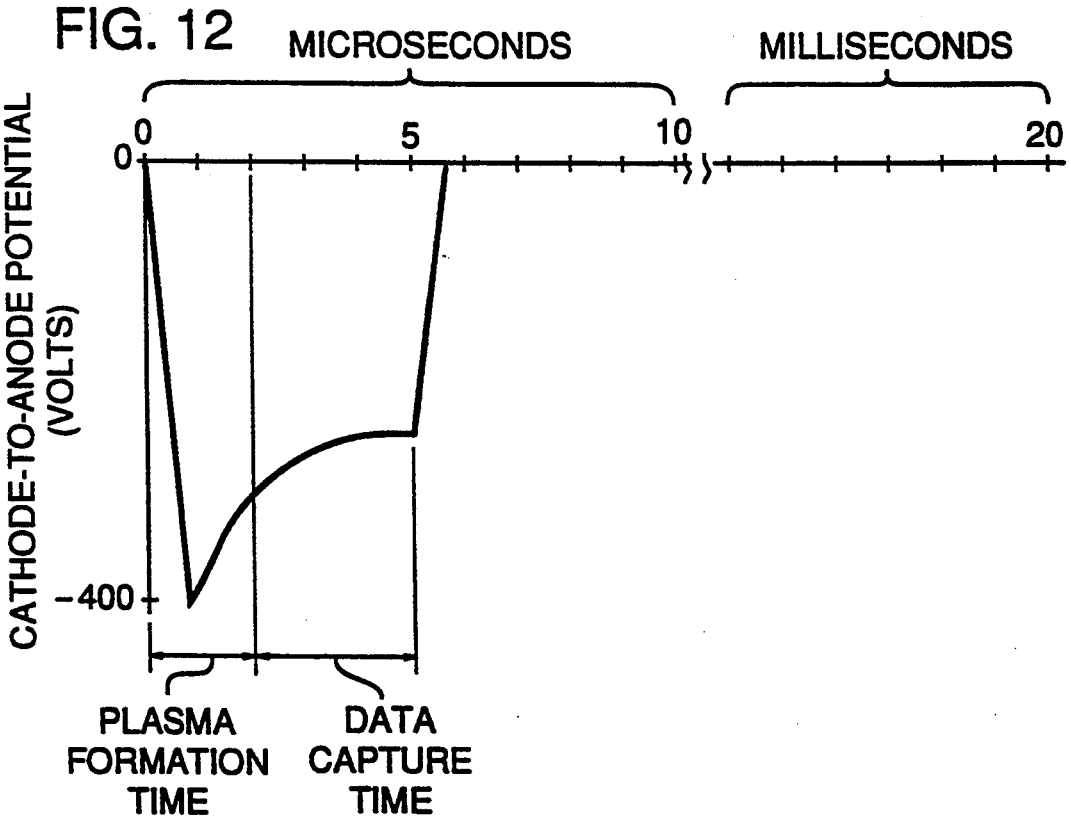
FIG. 12 is a qualitatively illustrative graph of the electrical potential expected to exist between the reference electrode (anode) and the row electrode (cathode) as a function of time after provision of an ionization signal between them for the electrical configuration shown in FIG. 11.

Each of FIGS. 8, 10, and 12 refers to channel 20' of FIGS. 7, 9, and 11, respectively, and qualitatively illustrates potentials expected to exist in a channel 20' that contains helium at a pressure of 280 millibars, in which reference electrode 30' and row electrode 62' have chromium surfaces, are each 75 microns (0.003 inch) wide and 2 microns (approximately 0.0001 inch) thick, and are spaced apart 200 microns (0.008 inch), the channel depth is 150 microns (0.006 inch), the channel has a top width of 450 microns (0.018 inch), the channel-to-channel spacing is approximately 508 microns (0.02 inch), the length of the active portion of channel 20' is 3.5 inches, and the data electrodes 18 are 0.006 inch wide, are spaced apart by 0.0015 inch, and have center-to-center spacing in groups of three of 0.020 inch. Qualitatively exemplary values of certain parameters taken from FIGS. 8, 10, and 12 are set forth in parentheses in the discussion below.

FIG. 7 shows in simplified form the electrical configuration of reference electrode 30' and row electrode 62' in channel 20'. A ground potential 100 is actually a system ground or common electrical reference potential for circuits associated with flat panel display system 10, including amplifiers 22 and 26 and scan control circuit 32, data driver 24, and data strobe 28 (FIG. 1). Reference electrode 30' and row electrode 62' thus are connected to ground potential 100 through various intermediate circuitry, only some of which is shown in FIGS. 7, 9, and 11.

The distortions described above are observed when operating a flat panel display system using a nematic liquid crystal material as electro-optic material 44. It appears that these distortions are due to improper charge distribution on free surface 88 of dielectric layer 46. As discussed above, the electric field across liquid crystal layer 44 in a data storage or display element 16 is determined by the first electrical signal or data signal applied to column electrode 18 above data storage or display element 16. That data signal induces the deposition of charge on free surface 88 of dielectric layer 46 as a result of ionization of the gaseous medium within channel 20'. The charge deposited on free surface 88 persists, and thus holds liquid crystal material 44 in the condition determined by the data signal on column electrode 18, until ionization in the next image field of the channel 20' that defines in part that data storage or display element 16. Until that next ionization, column electrode 18 carries data signals appropriate for display elements 16 located above other channels 20'.

Distortions appear to be due to an improper (in particular, non-symmetric with respect to reference electrode 30' and row electrode 62') distribution of charge deposited on free surface 88 following ionization of the gaseous medium in a channel 20'. FIG. 8 illustrates this situation qualitatively.

FIG. 8 is an illustrative qualitative graph of the electrical potential expected to exist between reference electrode (anode) 30' and row electrode (cathode) 62' as a function of time after provision of a strobe pulse or ionization signal or second electrical signal between them for the electrical configuration shown in FIG. 7. In a short time interval (0.7 microseconds) after initiation, the strobe pulse reaches its maximum amplitude (−400 volts) with respect to reference electrode 30', and the current between reference electrode 30' and row electrode 62' reaches its maximum peak value (80 milliamperes (not shown)). The plasma formation time (2 microseconds) shown in FIGS. 10, 12, and 14 thus easily includes the time needed for electrical discharge initiation.

As the gaseous medium within channel 20' ionizes and begins to conduct current, the potential between reference electrode 30' and row electrode 62' drops as current limiting circuitry (not shown) takes effect (5 microseconds after initiation of the strobe pulse) to reduce the potential difference and current between reference electrode 30' and row electrode 62' to predetermined values (in this example, 40 milliamperes and −270 volts to maintain that value of the current).

The value of the data signal on column electrode 18 is captured across liquid crystal material 44 essentially instantaneously (e.g., 0.5–1.0 microsecond) after ionization of the gaseous medium. The data capture time (shown in FIGS. 8, 10, and 12 as 5 microseconds) is a time adequate to ensure that the data signals on column electrodes 18 become fully expressed across electro-optic layer 44 and dielectric layer 46. The actual time that the discharge must be on to ensure that enough ions, electrons, and metastables are generated to ensure correct data capture may be shorter, possibly less than a microsecond. The data capture time shown in FIGS. 8, 10, and 12 is approximately the time needed after initiation of plasma discharge for current-limiting circuits to stabilize the potential and current between reference electrode 30' and row electrode 62'. It is not necessarily the time the discharge must be on to ensure that enough ions, electrons, and metastables are generated to ensure correct data capture.

As illustrated in FIG. 8, the potential between reference electrode 30' and row electrode 62' remains at some non-zero value $\Delta V$ (not to scale in FIG. 8) long beyond the plasma decay time. That potential difference may even fluctuate rather than diminishing as illustrated in FIG. 8. The non-zero value causes the nonsymmetric charge distributions that cause any one or more of the specific distortions discussed above. Horizontal cross-talk along the length of a channel occurs when row electrode 62' floats and the non-zero value $\Delta V$ is caused by the capacitive coupling to row electrode 62' of data signals on column electrodes 18.

The resulting deviations from the charge distributions that are supposed to exist on free surface 88 produce one or more of the specific distortions discussed above in the common case in which data signals have alternating polarity in immediately succeeding image fields. For certain electro-optic materials (for example, liquid crystals) it is necessary to ensure that no long term net DC electric field is applied to the materials; if such a field is applied, the material loses its desired electro-optical properties, or other undesired effects (such as dissociation of a liquid crystal material) can occur. In a flat panel display system this is preferably accomplished by alternating the polarity in immediately succeeding image fields of the data signals applied to the pixels.

To produce a condition where no long term net DC electric field is applied to the electro-optic material, first electrical signals or data signals on column electrodes 18 (FIG. 7) provide one of an OFF storage element state (corresponding, for example, to a pixel of least intensity in a flat panel display) and a preselected ON storage element state (corresponding, for example, in a flat panel display to a pixel of greatest intensity, a pixel of predetermined gray scale value, or a pixel of predetermined color intensity).

The first electrical signals include an OFF signal, an ON signal of higher potential, and an ON signal of lower potential. The ON signal of higher potential places first electrodes at a potential higher than the nominal electrical potential, and the ON signal of lower potential places first electrodes at a potential lower than the nominal electrical potential. For each preselected ON storage element state, the ON signals of higher and lower potential are preferably the same signal waveform (e.g., a square wave of constant amplitude such as 50 volts) but with polarity reversed with respect to the nominal electrical potential. The ON signals of higher and lower potential for each preselected ON state place a pixel in the same desired display condition (e.g., data signals that are one of 50 volts higher than and 50 volts lower than the nominal reference potential each correspond to the same black display condition of a pixel); another pair of ON signals of higher and lower potential places a pixel in another desired display condition (e.g., data signals that are one of 25 volts higher than and 25 volts lower than the nominal reference potential each correspond to the same gray scale display condition of a pixel).

Data signals producing an ON storage element state are provided in successive image fields in such a way that ON signals of higher potential are not provided in two immediately succeeding image fields, and ON signals of lower potential are not provided in two immediately succeeding image fields. As an example, data signals are provided in alternate image fields as one of (a) one of the ON signal of higher potential and the OFF signal and (b) one of the ON signal of lower potential and the OFF signal.

The nominal electrical potential is considered herein as constant and at zero volts during an image field even though it may vary from one image field to a succeeding image field. In one example, output amplifiers 22 for column electrodes 18 are more economically provided with an ability to provide data signals in an amplitude range (e.g., 50 volts) rather than with an ability to provide data signals between the amplitude range above a reference (e.g., 0 to +50 volts) and the amplitude range below a reference (e.g., 0 to −50 volts). To use more economical output amplifiers 22 in a drive system having alternating polarity of the type discussed above, the electrical potential of reference electrodes 30' is 0 volts for an image field in which column electrodes 18 are driven to a higher potential than reference electrode 30' and +50 volts for an image field in which column electrodes 18 are drive to a lower potential than reference electrode 30'. In the former image field a data signal at 0 volts produces an OFF storage element state and a data signal at +50 volts produces an ON storage element state. In the latter image field a data signal at +50 volts produces an OFF storage element state and a data signal at 0 volts produces an ON storage element state. For simplicity, the discussion herein proceeds with reference only to the nominal electrical potential—taken as 0 volts—of reference electrode 30' within each image field.

When channel 20' has a number of pixels provided with an ON signal and a number of pixels provided with an OFF signal, the pixels corresponding to free surfaces 88 (FIG. 7) on which electrical charge is deposited during data signal capture affect the field experienced by reference electrode 30' and row electrode 62'. The deposition of an electrical charge distribution on free surface 88 frequently leads to an improper, nonsymmetric distribution with respect to reference electrode 30' and row electrode 62'; the improper distribution is produced coincident with the application of ON signals of either higher or lower potential to a group of pixels in a channel.

FIG. 9 shows the electrical configuration of an improved electrode structure in accordance with a first preferred embodiment of the present invention. A resistor 102 is connected between reference electrode 30' and row electrode 62'. Resistor 102 completes a circuit with other electrical components connected to those electrodes, the circuit having a decay time through resistor 102 characterized by an RC-type decay with a decay time shorter than a time in which the quantity of the gaseous medium in one or more excited states declines to less than a quantity sufficient to provide the temporary ability to redistribute charge. Resistor 102 (e.g., a 47 kOhm resistor producing a decay time of less than 1 microsecond when used with the flat panel display described in connection with FIG. 8) eliminates the problem of non-symmetric charge distribution on free surface 88. An appropriate resistance of resistor 102 depends on the geometry of channel 20' and on the gaseous medium; an illustrative value is 10 times the resistance of the plasma during discharge with stabilized voltage and current. A resistance at such a multiple of the plasma resistance permits the strobe pulse or ionizing signal or second signal to maintain discharge in channel 20' and equalizes the potential of reference electrode 30' and row electrode 62' sufficiently quickly after the discharge time has elapsed.

A driver 104 is connected to a lead 106 leading to reference electrode 30'. Driver 104 holds the potential of reference electrode 30' at a predetermined potential (preferably the nominal electrical potential), at least when there is no kicker pulse provided to reference electrode as discussed in the copending application mentioned above. Driver 104 preferably actively clamps reference electrode 30' to the predetermined potential. Alternatively, reference electrode 30' is connected identically to a true electrical system ground. As a further alternative, amplifier 26 clamps lead 26' and thus row electrode 62' to the potential to which amplifier 104 clamps reference electrode 30' after the discharge time has elapsed. Any of the alternatives reduces or eliminates any one or more of the specific distortions discussed above.

FIG. 10 is an illustrative qualitative graph of the electrical potential expected to exist between reference electrode (anode) 30' and row electrode (cathode) 62' as a function of time after provision of a strobe pulse between them for the electrical configuration shown in FIG. 9. Proper choice of the resistance of resistor 102 allows the potential between reference electrode 30' and row electrode 62' to decline to zero or to some small value having no practical significance for distortions of the type described herein within a time after the data capture time has elapsed but before the gaseous medium has lost the temporary ability to redistribute charge. Resistor 102 can have a resistance bringing about potential equalization between reference electrode 30' and row electrode 62' within the neutralization time if ions or electrons are to provide the temporary ability to redistribute charge, within the time in which the quantity of metastables in the gaseous medium declines to less than a quantity sufficient to provide the temporary ability to redistribute charge if metastables are to provide that temporary ability, or another time if charge carriers and metastables are to provide that ability.

FIG. 11 shows the electrical configuration of an improved electrode structure in accordance with a second preferred embodiment of the invention. A switch 108 is provided connecting lead 106 with lead 26'. When closed, switch 108 shorts reference electrode 30' with row electrode 62' thus bringing both electrodes to the same electrical potential within a very short time (less than 1 microsecond (FIG. 12)). Switch 108 is controlled by logic circuit elements (not shown) to close and open at appropriate times. Switch 108 preferably closes immediately after the data capture time has elapsed if either charge carriers or metastables are to provide the temporary ability to redistribute charge. In FIG. 11 the potential of the reference electrode is brought to a predetermined value in the manner discussed in connection with FIG. 9.

FIG. 12 is a qualitatively illustrative graph of the electrical potential expected to exist between reference electrode (anode) 30' and row electrode (cathode) 62' as a function of time after provision of a strobe pulse or ionizing signal or second electrical signal between them for the electrical configuration shown in FIG. 11. FIG. 12 shows the very rapid provision of equal potential provided when the electrodes are shorted together.

Resistor 102 and switch 108 are not the only electrical circuits able to bring reference electrode 30' and row electrode 62' to the same electrical potential before the gaseous medium has lost the temporary ability to redistribute charge. Other such circuits pass between reference electrode 30' and row electrode 62' a current sufficient to equalize the electrical potential of those electrodes. Current may also pass between either or both of those electrodes and other circuit elements to achieve the result of equalizing the electrical potential of those electrodes.

The invention also provides an addressing structure operable to produce a display by forming multiple light pattern data storage elements for displaying an image. The addressing structure has appropriate electrical circuits to bring reference electrode 30' and row electrode 62' to the same potential, so that distortions are reduced in the image formed by the addressing structure. The circuits bring those electrodes to the same potential so that one or more of the specific distortions discussed above are reduced. The circuits discussed above carry out such steps. Circuits to reduce these types of distortion can be selected by experimental observation without detailed knowledge of any of the neutralization time, the decay time of metastables or the time within which the gaseous medium loses the temporary ability to redistribute charge. However, an even approximate knowledge of such time parameters assists the selection of such circuits by experimental observation.

The invention also includes methods, set forth in the following claims, of reducing distortions of the types discussed above in an addressing structure of the type described in the '149 patent. The methods include methods based on knowledge of the time parameters discussed above and methods based on selection of process steps by experimental observation of distortions of the foregoing types in a flat panel display.

It will be apparent to skilled persons that many changes may be made to details of the specific embodiments of the invention described herein without departing from the underlying principles thereof. The scope of the invention should, therefore, be determined only by the following claims.

We claim:

1. A method of operating an addressable electro-optic system having multiple light pattern data storage elements and including plural nonoverlapping first electrodes that extend in a first direction, a substrate having plural nonintersecting channels that extend along a major surface thereof in a second direction, each of the channels containing an ionizable gaseous medium and having one of plural second electrodes and one of plural reference electrodes extending along a substantial portion of the length of the channel, the first electrodes and the channels disposed face-to-face and spaced-apart with the first direction transverse to the second direction to define overlapping regions of the first electrodes and the channels, a layer of material having electro-optic properties positioned between the first electrodes and the substrate, the layer of electro-optic material and the overlapping regions defining plural light pattern data storage elements that selectively store an image field representing typically nonuniform light pattern information carried by the first electrodes, the method comprising the steps of, for each channel in an image field:

providing first electrical signals to the first electrodes;

providing for a discharge time second electrical signals between the second electrode and the reference electrode, the second electrical signals causing a discharge in the gaseous medium and thereby imparting to the gaseous medium a discharge time ability to redistribute electrical charge among surfaces exposed to the gaseous medium, the first and second signals cooperating during the discharge time to change the electro-optical properties of the regions of the layer associated with the storage elements, the second electrical signals further providing in one or more excited states an excited quantity of the gaseous medium, the excited quantity sufficient after the discharge time has elapsed to provide the gaseous medium with a temporary ability to redistribute charge to make the interior of the channel free of electric fields; and bringing the second electrode and the reference electrode to the same electrical potential after the discharge time has elapsed but before the gaseous medium has lost the temporary ability to redistribute charge.

2. The method of claim 1, wherein:

the excited quantity comprises a quantity of metastables;

the metastables readily produce charge carriers under conditions existing in the channel after the discharge time has elapsed; and the quantity of metastables is sufficient to provide the gaseous medium with the temporary ability to redistribute charge.

3. The method of claim 2, wherein the step of bringing the second electrode and the reference electrode to the same electrical potential is accomplished before the quantity of metastables declines to less than a quantity sufficient to provide the temporary ability to redistribute charge.

4. The method of claim 2, wherein:

the excited quantity further comprises a quantity of charge carriers;

the quantity of charge carriers is substantially neutralized within a neutralization time after the discharge time has elapsed; and a sufficient number of the quantity of metastables has a decay time exceeding the neutralization time to provide the gaseous medium with the temporary ability to redistribute charge.

5. The method of claim 1, wherein:

the excited quantity comprises a quantity of charge carriers;

the quantity of charge carriers is sufficient to provide the gaseous medium with the temporary ability to redistribute charge; and the step of bringing the second electrode and the reference electrode to the same electrical potential is accomplished before the quantity of the charge carriers declines to less than a quantity sufficient to provide the temporary ability to redistribute charge.

6. The method of claim 1, wherein the step of bringing the second electrode and the reference electrode to the same electrical potential comprises the step of transferring between the second electrode and the reference electrode a quantity of charge sufficient to equalize the electrical potential of the second electrode and the reference electrode.

7. The method of claim 1, wherein the step of bringing the second electrode and the reference electrode to the same electrical potential comprises the step of connecting a resistor between the second electrode and the reference electrode, the resistor completing a circuit with a decay time through the resistor shorter than a time in which the excited quantity declines to less than a quantity sufficient to provide the temporary ability to redistribute charge.

8. The method of claim 1, wherein the step of bringing the second electrode and the reference electrode to the same electrical potential comprises the step of shorting the second electrode to the reference electrode after the discharge time has elapsed but before the excited quantity declines to less than a quantity sufficient to provide the temporary ability to redistribute charge.

9. The method of claim 1, wherein the addressable electro-optic system forms multiple light pattern data storage elements for displaying an image, and further comprising the step of bringing one of the second electrode and the reference electrode to a predetermined potential before the gaseous medium loses the temporary ability to redistribute charge, whereby distortions in the image are reduced.

10. The method of claim 9, wherein:

the reference electrode has a nominal electrical potential; and the predetermined potential is the nominal electrical potential.

11. The method of claim 10, wherein the step of bringing one of the second electrode and the reference electrode to the predetermined potential comprises the step of clamping the reference electrode to the nominal electrical potential.

12. The method of claim 1, wherein the addressable electro-optic system forms multiple light pattern data storage elements for displaying an image, and wherein the step of bringing the second electrode and the reference electrode to the same electrical potential is accomplished so that distortions in the image are reduced.

13. The method of claim 12, wherein the step of bringing the second electrode and the reference electrode to the same electrical potential comprises the step of passing between the second electrode and the reference electrode an electrical current of a character that equalizes the potential of the second electrode and the reference electrode.

14. The method of claim 12, wherein the step of bringing the second electrode and the reference electrode to the same electrical potential comprises the step of connecting a resistor between the second electrode and the reference electrode, the resistor completing a circuit with a decay time through the resistor short enough to reduce distortions in the image.

15. The method of claim 12, wherein the step of bringing the second electrode and the reference electrode to the same electrical potential comprises the step of shorting the second electrode and the reference electrode together after the discharge time has elapsed.

16. An addressable electro-optic system having multiple light pattern data storage elements for forming an image, comprising:

a first substrate supporting on a major surface thereof plural nonoverlapping first electrodes that extend in a first direction;

a second substrate having plural nonintersecting channels that extend along a major surface thereof in a second direction, each of the channels containing an ionizable gaseous medium and having one of plural second electrodes and one of plural reference electrodes extending along a substantial portion of the length of the channel;

the first and second substrates disposed face-to-face and spaced-apart with the first direction transverse to the second direction to define overlapping regions of the first electrodes and the channels;

a layer of material having electro-optic properties positioned between the first and second substrates, the layer of electro-optic material and the overlapping regions defining plural light pattern data storage elements that selectively store an image field representing typically nonuniform light pattern information carried by the first electrodes;

first means for providing first electrical signals to the first electrodes;

second means for providing for a discharge time second electrical signals between the second electrode and the reference electrode in each channel in an image field, the second electrical signals causing a discharge in the gaseous medium and thereby imparting to the gaseous medium a discharge time ability to redistribute charge among surfaces exposed to the gaseous medium, the first and second electrical signals cooperating during the discharge time to change the electro-optical properties of the regions of the layer associated with the storage elements, the second electrical signals further providing in one or more excited states an excited quantity of the gaseous medium, the excited quantity sufficient after the discharge time has elapsed to provide the gaseous medium with a temporary ability to redistribute charge to make the interior of the channel free of electric fields;

third means for bringing the second electrode and the third electrode in each channel to the same electrical potential after the discharge time has elapsed but before the ionizable gaseous medium has lost the temporary ability to redistribute charge.

17. The system of claim 16, wherein:

the excited quantity comprises a quantity of metastables;

the metastables readily produce charge carriers under conditions existing in the channel after the discharge time has elapsed;

the quantity of metastables is sufficient to provide the gaseous medium with the temporary ability to redistribute charge.

18. The system of claim 17, wherein the third means brings the second electrode and the reference electrode to the same electrical potential before the quantity of the metastables has declined to less than a quantity sufficient to provide the temporary ability to redistribute charge.

19. The system of claim 17, wherein:

the excited quantity further comprises a quantity of charge carriers;

the quantity of charge carriers is substantially neutralized within a neutralization time after the discharge time has elapsed; and a sufficient number of the quantity of metastables has a decay time exceeding the neutralization time to provide the gaseous medium with the temporary ability to redistribute charge.

20. The system of claim 16, wherein:

the excited quantity comprises a quantity of charge carriers;

the quantity of charge carriers is sufficient to provide the gaseous medium with the temporary ability to redistribute charge; and the third means brings the second electrode and the reference electrode to the same electrical potential before the quantity of charge carriers declines to less than a quantity sufficient to provide the temporary ability to redistribute charge.

21. The system of claim 16, wherein:

the plural light pattern data storage elements are operable for forming an image; and the third means comprises an electrical circuit for bringing the second electrode and the third electrode in each channel to the same electrical potential after the discharge time has elapsed so as to reduce distortions in the image.

22. The system of claim 16, further comprising a fourth means for bringing the potential of one of the second electrode and the reference electrode to a predetermined potential before the gaseous medium has lost the temporary ability to redistribute charge, whereby distortions in the image are reduced.

23. The system of claim 22, wherein the fourth means comprises a driver operable actively to clamp the potential of one of the reference electrode and the row electrode to a predetermined potential.

24. The system of claim 22, wherein the fourth means comprises a driver operable actively to clamp the potential of the reference electrode to a predetermined potential.

25. The system of claim 22, wherein the predetermined potential is the nominal electrical potential of the reference electrode in an image field.

* * * * *